United States Patent [19]

Belsterling

[11] Patent Number: 4,932,541

[45] Date of Patent: Jun. 12, 1990

[54] STABILIZED SHIPBOARD CRANE

[75] Inventor: Charles A. Belsterling, Blue Bell, Pa.

[73] Assignee: Calspan Corporation, Buffalo, N.Y.

[21] Appl. No.: 342,509

[22] Filed: Apr. 24, 1989

[51] Int. Cl.[5] ..... B66C 23/53

[52] U.S. Cl. ..... 212/191; 212/148; 212/192; 358/107; 414/138.3; 414/139.7

[58] Field of Search ..... 212/147, 148, 190, 191, 212/192, 193, 194; 358/101, 107; 414/138.3, 139.7

[56] References Cited

U.S. PATENT DOCUMENTS

| | | | |
|---|---|---|---|
| Re. 27,051 | 12/1971 | Cappel . | |
| 3,107,791 | 10/1963 | Michael | 212/148 |
| 3,567,040 | 3/1971 | Thomson | 212/193 |
| 3,591,022 | 7/1971 | Polyakov et al. | 414/138.3 |
| 3,768,664 | 10/1973 | Bauer et al. | 212/193 |
| 4,126,298 | 11/1978 | Lub . | |
| 4,354,608 | 10/1982 | Wudtke . | |
| 4,611,292 | 9/1986 | Ninomiya et al. | 358/101 |
| 4,652,917 | 3/1987 | Miller | 358/107 |
| 4,678,329 | 7/1987 | Lukowski Jr. et al. . | |
| 4,684,247 | 9/1987 | Hammill, III . | |
| 4,744,664 | 5/1988 | Offt et al. | 358/101 |
| 4,819,496 | 4/1989 | Shelef . | |
| 4,843,460 | 6/1989 | LeGuet et al. | 358/107 |

FOREIGN PATENT DOCUMENTS

| | | | |
|---|---|---|---|
| 2053590 | 5/1972 | Fed. Rep. of Germany | 212/147 |
| 22293 | 2/1977 | Japan | 212/148 |

*Primary Examiner*—Sherman D. Basinger
*Assistant Examiner*—Thomas J. Brahan
*Attorney, Agent, or Firm*—Biebel, French & Nauman

[57] ABSTRACT

The invention is directed to a stablilized cargo-handling system using means for stabilizing suspended cargo in all six degrees of freedom using six individually controlled cable in tension in a unique kinematic arrangement. Inertial and distance sensors, coupled with high-performance cable drives, provide the means to control the multi-cabled crane automatically. The distance sensors are used to track the target container or lighter during the pickup and setdown modes of operation; the inertial sensors are used to prevent pendulation during transfer of the cargo from the seagoing cargo ship to the vicinity of the receiving lighter. The complete stabilized shipboard crane system permits safe and efficient operations in relatively high sea states.

8 Claims, 5 Drawing Sheets

STABILIZED SHIPBOARD CRANE

BACKGROUND OF THE INVENTION

When off-loading containers and break-bulk cargo from large oceangoing ships (or a dock) onto a variety of lighters (and other small craft), off-loading must be accomplished in all types of weather and in the presence of high sea states. Problems arise both due to the motions of the vessels in inertial space and the motions of the vessels relative to each other.

Existing shipboard cranes use a single cable with a cargo coupling mechanism (or spreader) suspended from an overhead structure. Ship motion may force the cargo (or spreader) into pendulous action, allowing it to swing unchecked. Difficulty may be encountered when trying to mate the spreader with a container that is on the oceangoing vessel itself. Furthermore, depositing a swinging container onto a moving lighter without damage to cargo and hazards to personnel is also difficult.

SUMMARY OF THE INVENTION

The invention is directed to a new, stabilized cargo-handling system using means for stabilizing suspended cargo in all six degrees of freedom using six individually controlled cables in tension in a unique kinematic arrangement. Inertial and distance sensors, coupled with high-performance cable drives, provide the means to control the multi-cabled crane automatically. The distance sensors are used to track the target container or lighter during the pickup and setdown modes of operation; the inertial sensors are used to prevent pendulation during transfer of the cargo from the seagoing cargo ship to the vicinity of the receiving lighter. The complete stabilized shipboard crane system permits safe and efficient operations in relatively high sea states.

The control systems for the stabilized crane have been designed for two operating modes. Both are under the primary control of a human operator, using visual feedback from the spreader/container and the target lighter. Assuming that the operator has picked up the container from his own ship's deck, the operator then rotates his turntable to swing the container out over the water. At this time the control system is in the "TRANSPORT" mode. In this case, inertial sensors on the spreader feed back signals through appropriate networks to modify the operator's command to automatically eliminate pendulous swinging.

The operator then commands the system to lower the container. When the spreader approaches within about 20 ft. of the target lighter, the distance sensors "acquire" the target and automatically switch the control system to the "SET-DOWN" mode. The distance sensors employ a light source and receiver mounted on a spreader, and a plurality of reflectors are strategically mounted on the target lighter. The signals from the distance sensors are fed back through appropriate networks to modify the operator's commands in accordance with the relative motion of the cargo and deck; the drives run the cables in the direction necessary to synchronize the motion of the container with the motion of the moving lighter so the container may contact the lighter deck with a negligible difference in instantaneous velocity.

In the preferred embodiment of the invention, the cables are attached in pairs at three symmetrically spaced apart points on the cargo spreader. The cables are run in adjacent pairs to the overhead crane structure and through three pairs of symmetrically spaced pulleys or sheaves on a triangular frame supported on three booms extending from three masts. All six cables are led back to the ship's deck crane tower, which supports six identical computer-controlled cable-drive systems. By the proper combination of cable extensions and retractions, these drives can position the cargo in six degrees-of-freedom.

The three masts are mounted on a turntable on the deck of the oceangoing vessel and support the booms through cables from their tops. This minimizes the mass of the booms by eliminating bending moments and minimizing the reaction forces they must sustain.

For the pickup and set-down modes of operation, distance sensors are provided that lock onto targets on the container during pickup and lock onto targets on the lighter during set-down. In these modes, the crane is designed to slave the motion of the spreader (cargo) to match the motion of its target, thereby eliminating cargo damage and safety hazards.

When the picked-up container is being transported from the oceangoing vessel to the vicinity of the target lighter, a set of accelerometers is provided on the spreader to feed back any dynamic motions and stabilize the spreader in inertial space. This mode is designed to minimize power consumption and the stress on the stabilized crane structures and cable drives. If the stabilization is perfect, there are no dynamic forces required by the spreader and its container payload, only the static forces due to their weight. The cable drives will be constantly extending and retracting the cables, but the only power consumed will be due to the system losses.

Both sets of sensors are designed to develop signals to control the cable drives. However, those signals are referenced to a coordinate system incompatible with the cable drives. The distance sensor is referenced to the target vehicle, the acceleration sensors are referenced to inertial coordinates, and the cable drives are referenced to the crane structures. Therefore, an on-line computer is employed to convert the error signals continuously from their respective coordinate systems into command signals for the six cable lengths.

It is therefore an object of this invention to provide an improved apparatus for stabilizing cargo as it is transferred from one vessel to another under conditions where there may be relative motion between the two vessels. Specifically, it is an object of this invention to employ a stabilizing crane apparatus utilizing six cables, each individually controlled and operating in response to the relative position between the cargo and the deck of the vessel on which the cargo is to be placed, to maintain the cargo in a stable position relative to that deck during at least the set down phase of the transfer operation.

It is a further object of this invention to provide a stabilized crane apparatus for transferring cargo from a first deck at one location to a second deck at another location wherein there may be relative motion therebetween, such as heaving, pitching, rolling, yawing and moving longitudinally and laterally, said apparatus comprising a plurality of winches associated with the first deck; a support cable attached to each of said winches; an upper cable guide including means for guiding pairs of said support cables; means for suspending said upper cable guide generally above the second deck; spreader means for connecting to and supporting the cargo; means for securing different pairs of said cables to said spreader means; position sensing means for measuring the distance from and the attitude of said spreader means relative to the second deck; and circuit means responsive to the output of said position sensing means for providing control signals to said winches to control the length of said cables and thereby maintain a stable positional relationship between the cargo and the second deck.

Other objects and advantages of the invention will be apparent from the following description, the accompanying drawings and the appended claims.

BRIEF DESCRIPTION OF THE DRAWINGS

FIG. 9 is a simplified diagram showing the various components which would typically make up a complete system.

DESCRIPTION OF THE PREFERRED EMBODIMENT

Figure 2:
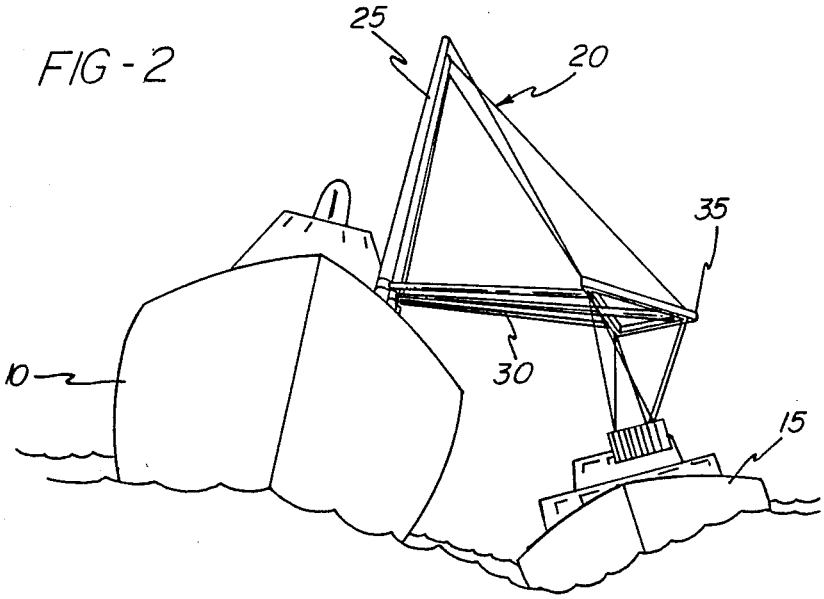
FIGS. 1 and 2 illustrate a cargo ship transferring cargo to a lighter with the two ships moving relative to each other due to the action of the sea.
Figure 1:
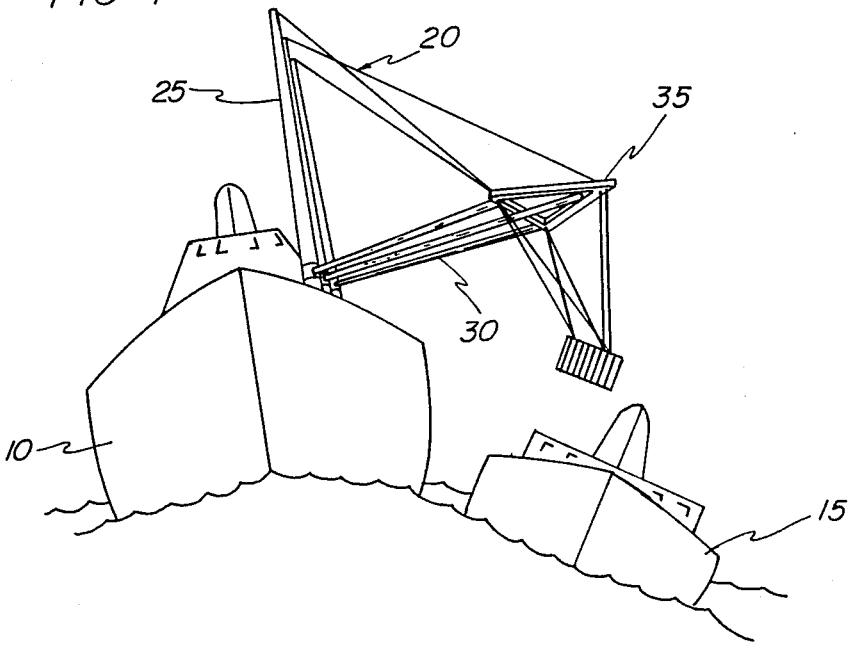

Referring now to the drawings, and particularly to FIGS. 1 and 2, a stabilized crane apparatus is shown for use in transferring cargo from a cargo vessel 10 to a lighter 15 or other smaller craft. The cargo vessel and the lighter are subject to relative motion in all six degrees of freedom due to the action of the sea. The amount of relative motion will, of course, depend upon the state of the sea and the hydrodynamics of the vessels.

The deck of the first or cargo vessel 10 supports a basic crane apparatus 20 which includes one or more masts 25 which extend upwardly perpendicular from the first deck, and one or more boom members 30 which extend outwardly from the mast to a triangular frame member 35, shown in FIG. 3, which serves as an upper cable guide, as will be explained. Cables 40 extend from the top of the mast to the upper cable guide 35. These support cables 40 are usually of fixed length and together with the booms 30 keep the plane of the upper cable guide 35 fixed relative to the plane of the deck of the first vessel 10.

Figure 3:
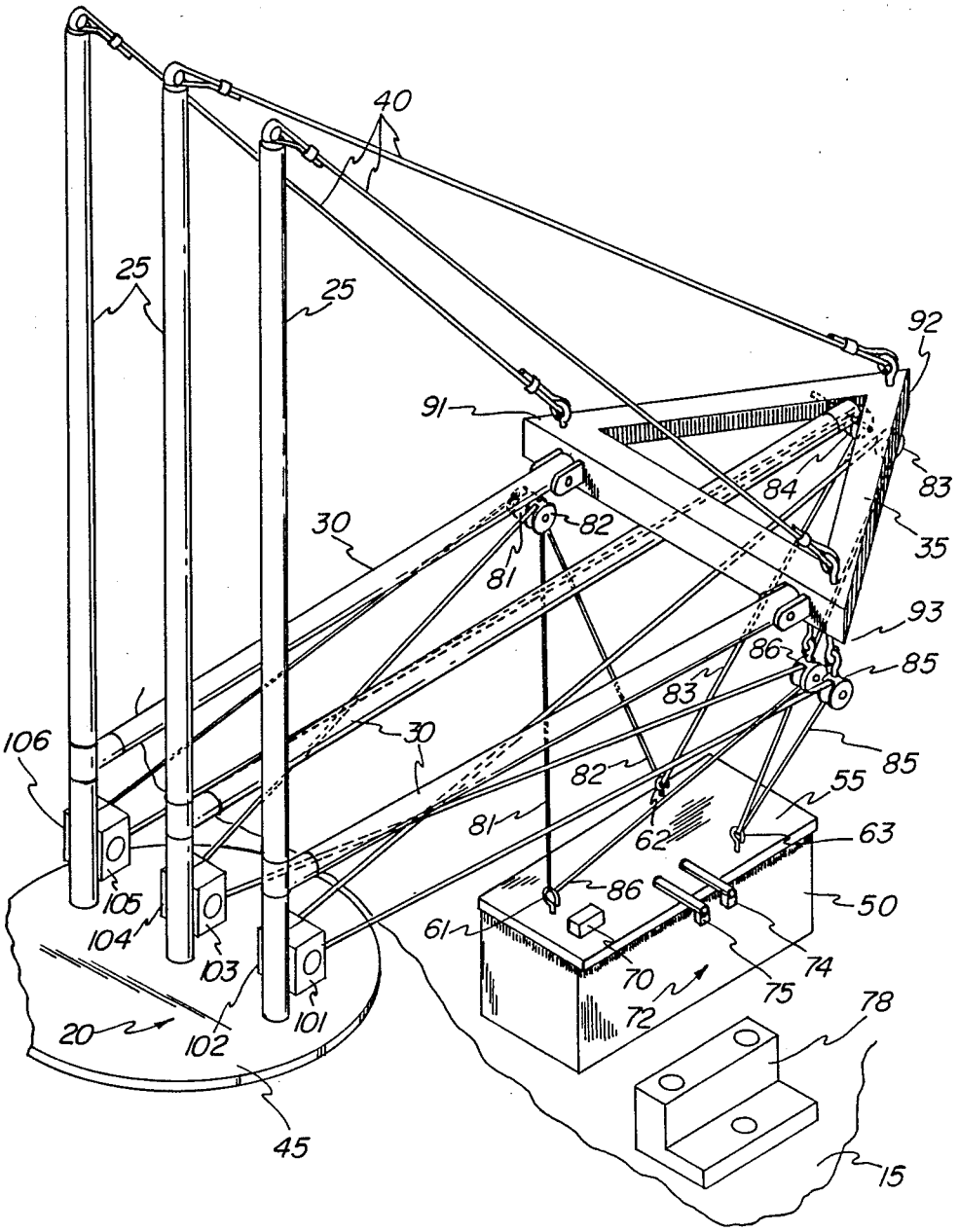
FIG. 3 is a perspective view of a crane apparatus supporting a cargo for transfer to the lighter.

The crane apparatus 20 shown in FIG. 3 includes three masts 25 which would typically be mounted upon a rotating platform 45 so that the operator could pick up a cargo container 50 from the hold of the cargo ship, lift it free of the ship, and then the platform 45 would be rotated so that the cargo could then be placed on the deck of the receiving ship or lighter 15.

The cargo container 50, typically 40′ long, 8′ wide and 8′ deep, is attached to a spreader 55 by conventional attaching means (not shown). The spreader itself includes means (61, 62, 63) for attaching cables which will be used both to support and to stabilize and position the cargo. The spreader 55 also carries a lower cable guide 155, an inertial sensor 70 and a position sensor 72. As will be explained, the inertial sensor measures the movement of the cargo relative to inertial space, and from the output of this sensor, control signals are generated that will reduce or eliminate the swinging motion that usually accompanies the transfer of the cargo from the first to the second ship. The position sensor 72 measures the distance and the relative position or attitude of the spreader with respect to the dec of the second ship, and this device will provide the control signals that will maintain the cargo in a stable positional relationship with the deck of the second ship during the las phase of the transfer operation.

Figure 4:
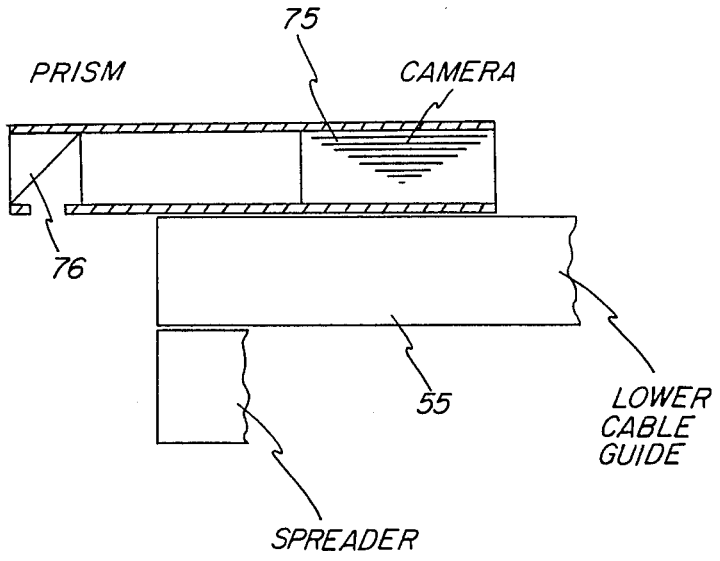
FIG. 4 is an elevational view of the camera portion of the position sensor.
Figure 5:
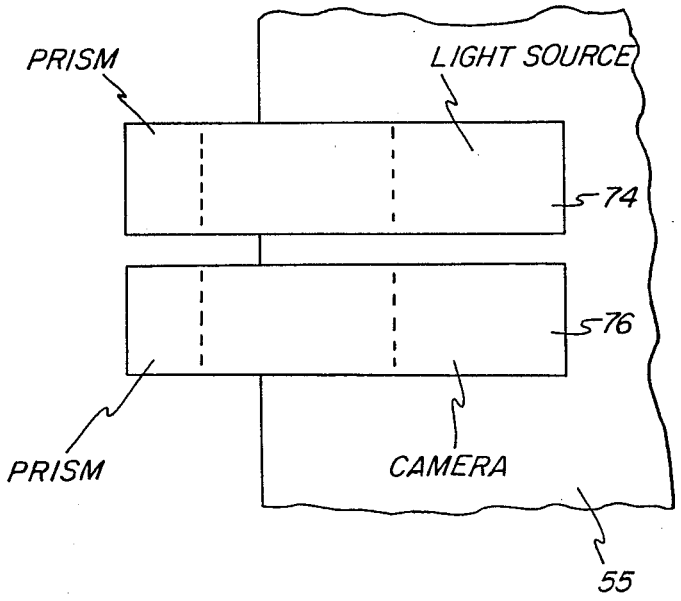
FIG. 5 is a plan view showing the camera and light source on the lower cable guide.

Referring to FIG. 3, the inertial sensor 70 mounted on the spreader is a conventional device which measures acceleration in three planes. The distance and attitude sensor 72 includes a light source 74 and a camera 75 mounted on the lower cable guide 155 which cooperates with a target 78 fixed relative to the deck of the second ship 15. As shown in FIGS. 4 and 5, the camera 75 views the target 78 by means of a prism 76. The light source likewise is directed toward the target 78 by means of a similar prism (not shown)

The target 78 includes three reflector elements 79 each of which reflects the light from the light source 74. These reflector elements are preferably retroreflectors so to return the greatest amount of light possible. These reflector elements form an image plane of the light source which is in a plane oriented other than normal to a line between the light source and the plane formed by the image. The light source is not within the circle formed by these three reflector elements, nor is it within the plane itself A more complete description of this distance and attitude sensing device may be found in U.S. Pat. Nos. 4,678,329 and 4,684,247.

A total of six cables (81–86) are used to position the cargo. These cables pass through bearing assemblies (91, 92, 93) in the upper cable guide. As shown in FIG. 3, two cables pass through each bearing assembly, each including a pair of pulleys, one for each cable. Each cable is attached to a corresponding winch (101–106) which has response characteristics and power requirements sufficient to move the cables quickly in response to the relative motion between the cargo and the deck of the second ship. Hydraulic winches may be preferable for this purpose.

Cables 81 and 82 pass through the first bearing assembly 91 and are attached to attachment points 61 and 62 on the spreader 55. Cables 83 and 84 pass through the second bearing assembly 92 and are attached to attachment points 62 and 63. Cables 85 and 86 pass through the third bearing assembly 93 and are attached to attachment points 63 and 61, respectively.

These cables (81–86) under appropriate control by the winches (101–106), permit the placement of the spreader relative to the upper cable guide in six degrees of freedom, thereby allowing the control mechanism to compensate for heaving, pitching, rolling, yawing, and a limited amount of both lateral and longitudinal motion of the second deck with respect to the cargo.

Figure 6:
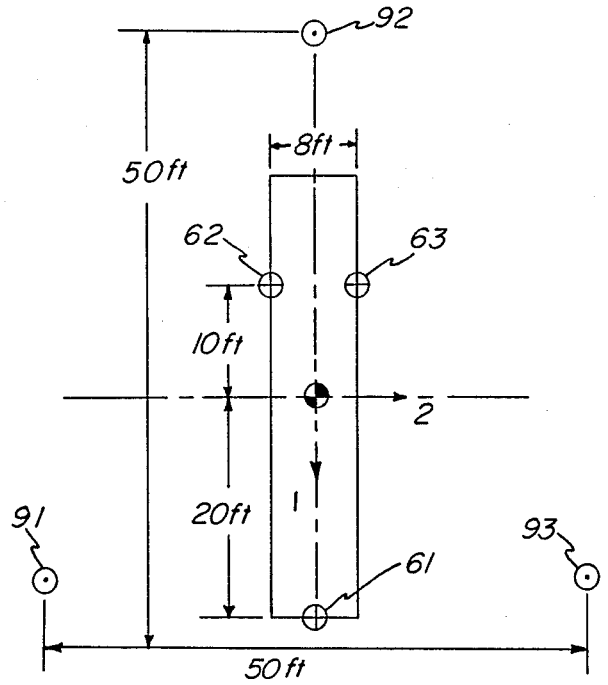
FIG. 6 is a plan view showing the location of the attachment points of cables to a spreader and through the lower cable guide.
Figure 7:
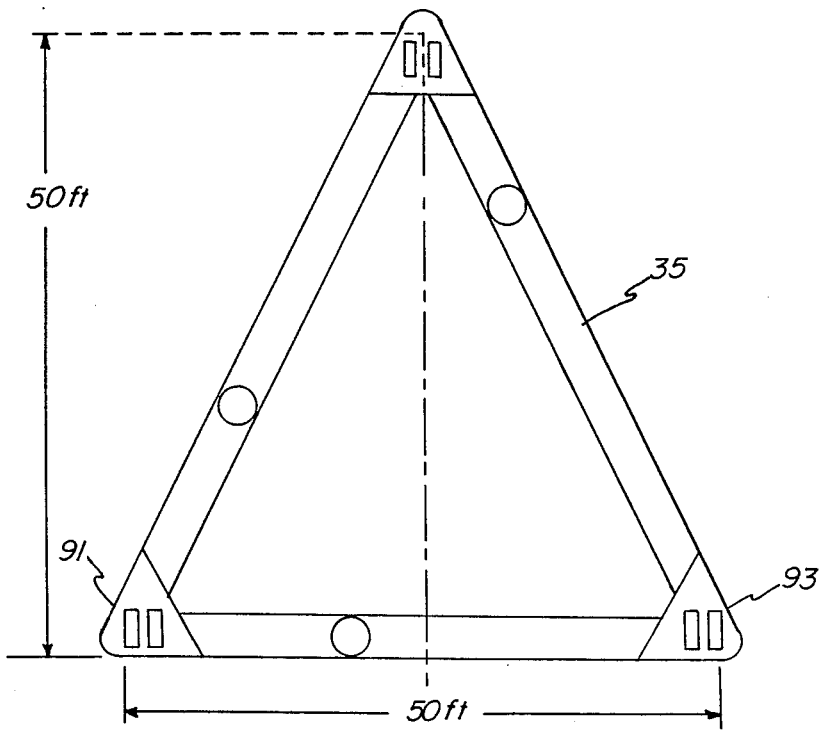
FIG. 7 is a plan view of the upper cable guide which guides the cables to the spreader.

It will be noted from FIGS. 6 and 7 that the spacing between the attachment points 61–63 on the spreader are substantially within the boundaries established by the bearing assemblies 91–93 on the upper cable guide 35. This permits the movement of the spreader within limits in all six degrees of freedom, with those limits being established by the size of the cargo container and the expected sea states and relative motion between the two ships.

Likewise, the design characteristics of the winches must be able to accommodate the speed of relative motion between the two ships, and have sufficient power to raise and lower the load, especially during the transfer operation since it is not expected that any substantial energy, other than friction losses, are needed to maintain the cargo in a stable position during the inertial phase of the transfer operation.

For the cargo-handling system to track the motion of the lighter as it sets a container down onto its deck, it is assumed that the following sea conditions are typical:

| | |
|---|---|
| Heave | ± 32 in (± 81 cm) |
| Surge | ± 12 in (± 30 cm) |
| Sway | ± 20 in (± 51 cm) |
| Pitch | ± 3 deg (± 0.05 rad) |
| Roll | ± 6 deg (± 0.10 rad) |
| Yaw | ± 1 deg (± 0.02 rad) |

These motions of the container must be produced without any of the six cables going slack (zero tension).

Because of the symmetry of the system and the omnidirectional pattern of the wave motion, the optimum configuration would have all cable tensions equal when the container is stationary. To accomplish this, the attachment points 62 and 63 are placed half the distance between attachment point 61 and the center of gravity (CG), as illustrated in FIG. 6.

It was also recognized that the upper cable bearings must have a greater span than the attachment points on the spreader in order to provide lateral and longitudinal forces on the container. This means that the cables would have to "fan out" from the sides of the spreader. Therefore, the cables would rub the sides of the container stack when retrieving low-down, in-stack containers.

Figure 8:
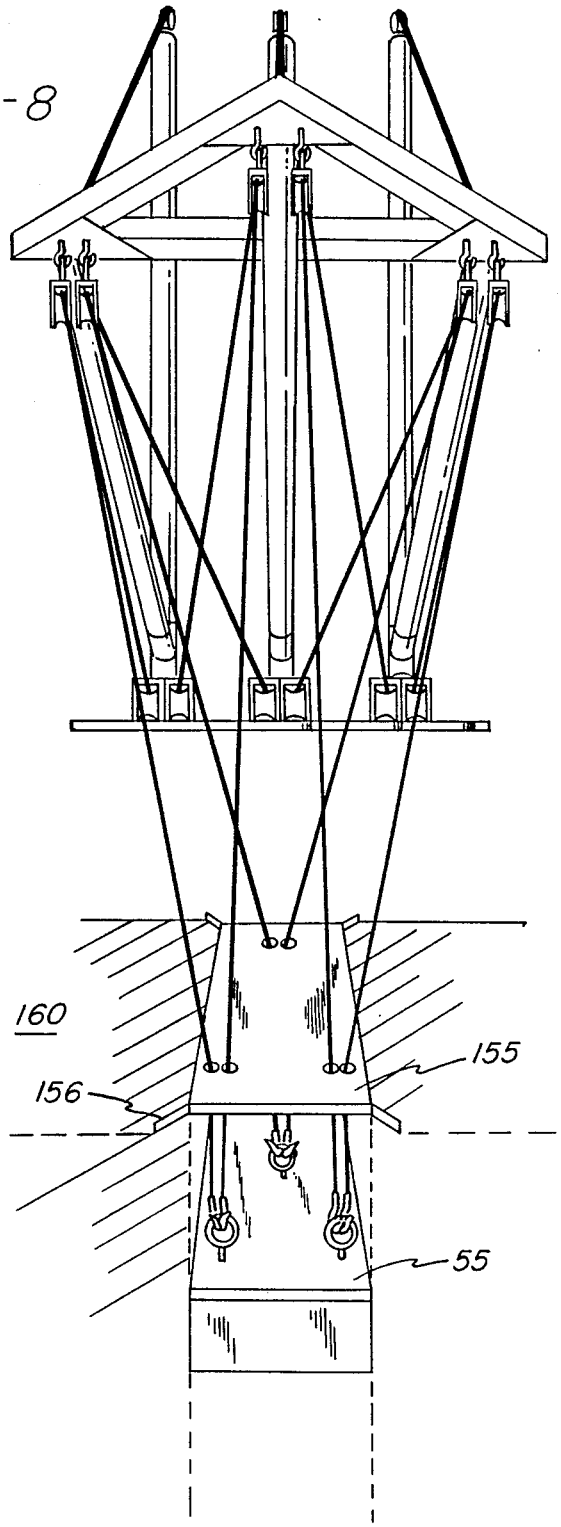
FIG. 8 is a perspective view showing how the lower cable guide eliminates interference when the cargo is within a constrained area.

FIG. 8, shows the retrieving of containers situated in an area where the cables above the spreader and the upper cable guide are spread out. The cables pass through a lower cable guide 155 which is provided with means to allow the cables to pass freely therethrough for normal connection with the spreader 55. The cable guide 155 normally rests on the top of the spreader, and it is provided with projections 156 at each corner which, when the spreader enters the container-sized hole in the stack, engage the top of adjacent containers in the restricted area 160. The cable guide will remain at the top of the stack, as shown in FIG. 8, and will guide the cables within the container-sized hole as the spreader 55 is lowered and raised.

As an example of one typical application, the cable drives must be designed to accommodate two modes of operation: (1) lifting at a rate of 79 ft/min (24 m/min), and (2) tracking the movements of the lighter. Assuming a worst case condition of a container weight of 25.739 lb [115 kN]), at a 20-ft (6.1-m) drop, and a maximum acceleration of 0.1 g, the maximum tension is multiplied by 1.1 to obtain the maximum force required in each cable. In this worst case condition, where the cables can be as much as 50 degrees off vertical, then the cable velocity, V, is 79 ft/min/cos 50° or 2.05 ft/sec or 25 in/sec (63.5 cm/sec). The horsepower required for lifting each cable drive is therefore $(25739 \times 1.1 \times 2.05)/550$ or 106 hp (79 kW)

For this invention the following data for the cable drives was found to be adequate:

| | |
|---|---|
| Peak Cable Power | 140 hp (104 kW) |
| Average Cable Power | 89 hp (66 kW) |
| Maximum Force × Maximum Velocity | 170 hp (127 kW) |
| Peak System Power | 481 hp (359 kW) |
| Average System Power | 307 hp (229 kW) |

Either hydraulic or electric motors may be used to power the winches 101–106.

The functional block diagram of the complete, closed-loop control system for the stabilized crane is illustrated in FIG. 9. Beginning at the left side, the system can be described as follows.

The crane operator 120 is in command of the system, using visual feedback from the spreader/container 50, 55 and the target lighter 15. Assuming that he has picked up the container 50 from the deck of his own ship 10, the operator 120 rotates the turntable 45 to swing the container out over the water. The mode switch 110 is in the "TRANSPORT" mode. The accelerometers or inertial sensors 70 on the spreader 55 feed back signals through appropriate shaping networks to modify the operator's command signals in order to eliminate pendulous swinging automatically.

The operator then commands the system to lower the container. His command passes through a coordinate converter, which translates it into the appropriate commands to each of the six cable drives. The drives respond by producing torques proportional to the magnitude of the commands, which rotate the cable drums to vary the cable tensions. However, there is a significant mount of compliance (stretch) in the cables, so the equivalent forces are not applied to the spreader/container until the drive motors have rotated enough to relax the compliance of the cables. Then the forces applied to the spreader/container lower it as commanded by the crane operator.

When the spreader approaches within about 20 ft (6.1 m) of the target lighter, the sensors acquire the target and automatically switch the system to the "SET-DOWN" mode. Now the signals from the distance sensors are fed back through appropriate networks to modify the operator's command signals. The winches run the cables in the direction necessary to synchronize the motion of the container with the motion of the moving lighter.

While the form of apparatus herein described constitutes a preferred embodiment of this invention, it is to be understood that the invention is not limited to this precise form of apparatus and that changes may be made therein without departing from the scope of the invention, which is defined in the appended claims.

What is claimed is:

1. A stabilized crane apparatus for transferring cargo from a first deck at one location to a second deck at another location wherein there may be relative motion therebetween, such as heaving, pitching, rolling, yawing and moving longitudinally and laterally, said apparatus comprising a plurality of winches associated with the first deck;

a support cable attached to each of said winches;

an upper cable guide including means for guiding pairs of said support cables;

means for suspending said upper cable guide generally above the second deck;

spreader means for connecting to and supporting the cargo;

means for securing different pairs of said cables to said spreader means;

position sensing means for measuring the distance from and the attitude of said spreader means relative to the second deck; and circuit means responsive to the output of said position sensing means for providing control signals to said winches to control the length of said cables and thereby maintain a stable positional relationship between the cargo and the second deck.

2. The apparatus of claim 1 wherein said upper cable guide including bearing means for accommodating two support cables at each of three generally spaced locations thereon;

wherein first and second cables extend through said first bearing means, third and fourth cables extend through said second bearing means, and fifth and sixth cable extend through said third bearing means; and wherein said first and sixth cables are connected to a first common point on said spreader, said second and third cables are connected to a second common point on said spreader, and said fourth and fifth cables are connected to a third common point on said spreader.

3. The apparatus of claim 1 wherein said position sensing means includes a light source and camera associated with said spreader and at least three reflector elements associated with the second deck, said reflector elements together forming images of said light source in a plane oriented other than normal to a line from said light source to said plane.

4. The apparatus of claim 1 further including a lower cable guide positioned between said upper cable guide and said spreader and normally resting on said spreader, said lower cable guide carrying said position sensing means and provided with means for permitting said cables to extend into a confined area to deposit or retrieve a container without interference with adjacent container.

5. A stabilized crane apparatus for transferring cargo from a first deck at one location to a second deck at another location wherein there may be relative motion therebetween, such as heaving, pitching, rolling, yawing and moving longitudinally and laterally, said apparatus comprising an upper cable guide including bearing means for accommodating two support cables at each of three spaced apart locations thereon;

means for suspending said upper cable guide above the second deck;

a spreader including means for connecting to and supporting the cargo;

six cables extending from each of six winches, associated with said first deck, to three separate positions on said spreader through said upper cable guide, wherein first and second cables extend through said first bearing means, third and fourth cables extend through said second bearing means, and fifth and sixth cables extend through said third bearing means, and means for securing said cables to said spreader wherein said first and sixth cables are connected to a first common point on said spreader, said second and third cables are connected to a second common point on said spreader, and said fourth and fifth cables are connected to a third common point on said spreader.

6. The apparatus of claim 5 wherein said common points on said spreader form a second triangle smaller than said first triangle formed by the bearing means of said upper cable guide means.

7. The apparatus of claim 5 further including means for sensing the relative position of said spreader means and the second deck, said relative position sensing means including a light source and a light sensor associated with said spreader means and at least three reflector means associated with the second deck; and circuit means responsive to the output of said sensor for providing control signals to operate said winches and thereby maintain a stable relationship between the cargo and the second deck.

8. A stabilized crane apparatus for transferring cargo from a firsts deck at one location to a second deck at another location wherein there may be relative motion therebetween, such as heaving, pitching, rolling, yawing and moving longitudinally and laterally, said apparatus comprising a plurality of winches associated with the first deck;

a support cable attached to each of said winches;

an upper cable guide including means for guiding pairs of said support cables;

means for suspending said upper cable guide generally above the second deck;

spreader means for connecting to and supporting the cargo;

means for securing different pairs of said cables to said spreader means;

inertial sensing mans for sensing the movement of said spreader means relative to inertial space; and circuit means responsive to the output of said sensing means for providing control signals to said winches to control the length of said cables and thereby to minimize swinging of the cargo.

* * * * *